US010721567B2

(12) United States Patent
Kuhr et al.

(10) Patent No.: US 10,721,567 B2
(45) Date of Patent: Jul. 21, 2020

(54) ELECTRODYNAMIC SOUND TRANSDUCER

(71) Applicant: Sennheiser electronic GmbH & Co. KG, Wedemark (DE)

(72) Inventors: Markus Kuhr, Wedemark (DE); Kornelia Kaddig, Wietze (DE); Maik Schäfer, Hannover (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 0 days.

(21) Appl. No.: 15/778,860

(22) PCT Filed: Nov. 23, 2016

(86) PCT No.: PCT/EP2016/078559
§ 371 (c)(1),
(2) Date: May 24, 2018

(87) PCT Pub. No.: WO2017/089401
PCT Pub. Date: Jun. 1, 2017

(65) Prior Publication Data

US 2018/0332401 A1 Nov. 15, 2018

(30) Foreign Application Priority Data

Nov. 27, 2015 (DE) ..... 10 2015 120 637

(51) Int. Cl.

| | |
|---|---|
| ***H04R 1/28*** | (2006.01) |
| ***H04R 9/06*** | (2006.01) |
| ***H04R 7/12*** | (2006.01) |
| ***H04R 7/18*** | (2006.01) |
| ***H04R 9/02*** | (2006.01) |

(Continued)

(52) U.S. Cl.
CPC ..... *H04R 9/06* (2013.01); *H04R 1/1075* (2013.01); *H04R 7/12* (2013.01); *H04R 7/18* (2013.01); *H04R 9/02* (2013.01); *H04R 9/025* (2013.01); *H04R 1/2811* (2013.01); *H04R 5/033* (2013.01)

(58) Field of Classification Search
USPC ..... 381/345–349, 353–354
See application file for complete search history.

(56) References Cited

U.S. PATENT DOCUMENTS

| | | | |
|---|---|---|---|
| 5,459,290 | A | 10/1995 | Yamagishi |
| 7,031,488 | B2 | 4/2006 | Chang |

(Continued)

FOREIGN PATENT DOCUMENTS

| | | |
|---|---|---|
| CH | 400 239 | 10/1965 |
| CN | 2217861 | 1/1996 |

(Continued)

OTHER PUBLICATIONS

Wikipedia: Hohlraumresonator; Sep. 10, 2015; URL: de.wikipedia.org/w/index.php?, title=Hohlraumresonator&oldid=145891576—English version: Wikipedia: https://en.wikipedia.org/wiki/Resonator#Cavity_resonators, last edited on May 25, 2018.

*Primary Examiner* — Suhan Ni
(74) *Attorney, Agent, or Firm* — Haug Partners LLP

(57) ABSTRACT

An electrodynamic sound transducer that includes a chassis, a membrane with a hole in the centre of the membrane, a moving coil, a magnetic system, and a resonator that is placed in the hole in the centre of the membrane.

4 Claims, 3 Drawing Sheets

(51) Int. Cl.
*H04R 1/10* (2006.01)
*H04R 5/033* (2006.01)

(56) References Cited

U.S. PATENT DOCUMENTS

| | | | | |
|---|---|---|---|---|
| 8,731,231 | B2 | 5/2014 | Teske-Fischer et al. | |
| 2004/0091130 | A1* | 5/2004 | Goller | H04R 9/063 381/412 |
| 2005/0238197 | A1 | 10/2005 | Chang | |
| 2010/0183173 | A1 | 7/2010 | Teske-Fischer et al. | |
| 2012/0219171 | A1* | 8/2012 | Velican | H04R 1/22 381/353 |

FOREIGN PATENT DOCUMENTS

| | | |
|---|---|---|
| CN | 1491524 | 4/2004 |
| DE | 10 2007 005 620 | 8/2008 |
| WO | WO 02/054826 | 7/2002 |

* cited by examiner

ELECTRODYNAMIC SOUND TRANSDUCER

The present application claims priority from International Patent Application No. PCT/EP2016/078559 filed on Nov. 23, 2016, which claims priority from German Patent Application No. DE 10 2015 1209 637.4 filed on Nov. 27, 2015, the disclosures of which are incorporated herein by reference in their entirety.

FIELD OF THE INVENTION

It is noted that citation or identification of any document in this application is not an admission that such document is available as prior art to the present invention.

The present invention relates to an electrodynamic sound transducer.

U.S. Pat. No. 8,731,231 B2 discloses an electrodynamic sound transducer. The dynamic sound transducer comprises a chassis, a membrane with two beads, a moving coil and a magnetic system. The membrane has a hole in the centre.

When using headphones, a standing wave can be formed between the sound-emitting electroacoustic reproduction transducer and a head plane. The frequency of this standing wave depends on the distance between the electroacoustic reproduction transducer and the head plane. The frequency of the standing wave in the case of ear-enclosing headphones is typically between 5 kHz-8 kHz. Since these frequencies are located in the audible frequency range, a falsification of the audio signal can occur here.

In the priority-substantiating German patent application, the German Patent and Trademark Office searched the following documents: DE 10 2007 005 620 A1, WIKIPEDIA: cavity resonator; 10 Sep. 2015; URL: de(dot)wikipedia(dot)org/w/index.php?; title=Hohlraumresonator&oldid=145; 891576 and CH 400 239 A.

SUMMARY OF THE INVENTION

It is an object of the present invention to provide an electrodynamic sound transducer which reduces any falsification of the audio signal to be reproduced.

Thus an electrodynamic sound transducer comprising a chassis, a membrane with a hole in the centre of the membrane, a moving coil, a magnetic system and a resonator is provided, which is arranged in the hole in the centre of the membrane. The resonator has a first end with an opening on the ear-side end of the electrodynamic sound transducer and a second end on a side of the electrodynamic sound transducer facing away from the ear and a volume between the first and second end. The second end is configured to be closed. A resonator is formed by the narrowing at the first end of the resonator and by the volume located therebehind. The resonator can be configured as an acoustic absorption circuit or as a Helmholtz resonator.

According to a further aspect of the present invention, the first end with the opening of the resonator is in a plane of the membrane.

The invention relates to the idea to provide an electrodynamic sound transducer with a chassis, a membrane between two beads, a moving coil and a magnetic system. The membrane has no dome section so that a hole is provided in the centre of the membrane. In this region a (selective) resonator is provided according to the invention, for example in the form of an acoustic absorption circuit or a Helmholtz resonator. This resonator can be dimensioned in such a manner that the resonance frequency coincides with the standing wave. Thus, this resonator is provided at the point where a dome section is usually provided.

According to one aspect of the present invention, the resonator has an opening on a side facing the ear and a volume located therebehind. The opening can, for example, be provided in the membrane plane.

BRIEF DESCRIPTION OF THE DRAWINGS

Advantages and exemplary embodiments of the invention will be explained in detailed hereinafter with reference to the drawing.

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

Figure 1:
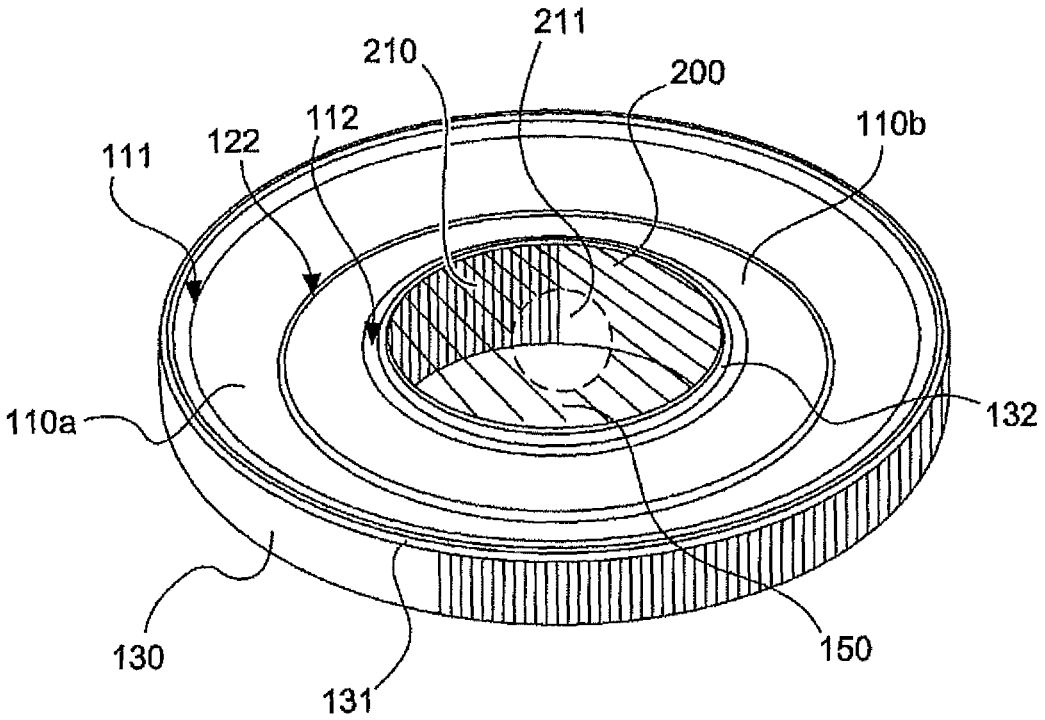
FIG. 1 shows a perspective view of an electrodynamic sound transducer according to a first exemplary embodiment.

FIG. 1 shows a perspective view of an electrodynamic sound transducer according to a first exemplary embodiment. The dynamic sound transducer comprises a chassis 130, a membrane 110 with two beads 110*a*, 110*b*, a moving coil 120 and a magnetic system 140. The membrane 110 has a hole 150 in the centre. The membrane 110 has an outer membrane support 111 and an inner membrane support 112 as well as a passage or a hole 150. A first bead 110*a* is provided between the outer membrane support 111 and the coil seat 122 and a second bead 110*b* is provided between the coil seat 122 and the inner membrane support 112.

Figure 2:
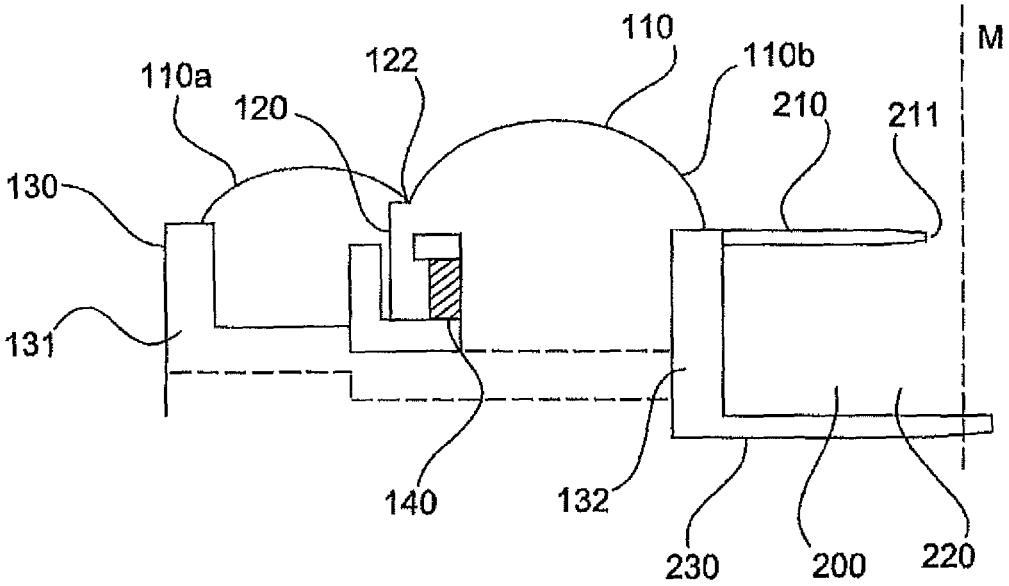
FIG. 2 shows a schematic sectional view of an electrodynamic sound transducer according to the first exemplary embodiment.

FIG. 2 shows a sectional view of a dynamic sound transducer according to a first exemplary embodiment. The dynamic sound transducer comprises a chassis 130, a membrane 110 with two beads 110*a*, 110*b*, a moving coil 120 and a magnetic system 140. The membrane 110 in this case has two beads but no dome section, i.e. a hole 150 is provided in the centre of the membrane.

The membrane system comprises an outer membrane support 111 and an inner membrane support 112 as well as a passage or a hole 150. A first bead 110*a* is provided between the outer membrane support 111 and the coil seat 122 and a second bead 110*b* is provided between the coil seat 122 and the inner membrane support 112.

Thus, an electrodynamic sound transducer with two beads 110*a*, 110*b* but without a dome section is to be provided. The two beads 110*a*, 110*b* are in this case fastened on the inside and outside to the chassis 130 of the dynamic transducer. A coil 120 for driving the membrane 110 is provided on the coil seat 122 between the outer and inner bead 110*a*, 110*b*. In the region of the membrane where the coil is arranged, i.e. on the coil seat 122, the membrane 110 is optionally designed to be stiff which can be achieved by a corresponding contour of the membrane 110. The membrane 110 can further optionally be softer towards the edge zones. i.e. the membrane supports 111, 112.

The dynamic sound transducer according to a first exemplary embodiment comprises a ring radiator with a vapour-deposited film (Duofol) in order to reduce the resonance frequency. Thus, a broad-band transducer can be provided which for example can be used in an open headphone.

In the area of the hole 150, a resonator 200 having a first end 210 with an opening 211, an opposite second end 230 and a volume 220 in between can be provided.

Optionally the opening 211 can be configured to be smaller than the hole 150 in the membrane 110. Optionally the diameter of the opening 211 can be smaller than the diameter of the hole 150.

The membrane 110 of the dynamic sound transducer can be vapour-deposited. As a result of the enlarged circumference of the membrane 110, vibration modes can propagate less efficiently. A uniform amplitude and frequency response can thus be obtained.

The chassis 130 can be configured to be circular or ring-shaped. The chassis 130 can have an inner end 132 and an outer end 131 which can each be configured as circular. The inner end 132 surrounds the hole 150 and receives the inner membrane support 112. The outer end 131 receives the outer membrane support 111. The membrane 110 is thus fastened to the inner and to the outer end 132, 131 of the chassis 130. The resonator 200 is provided in the centre, i.e. inside the inner end 132 and the hole 150.

Figure 3:
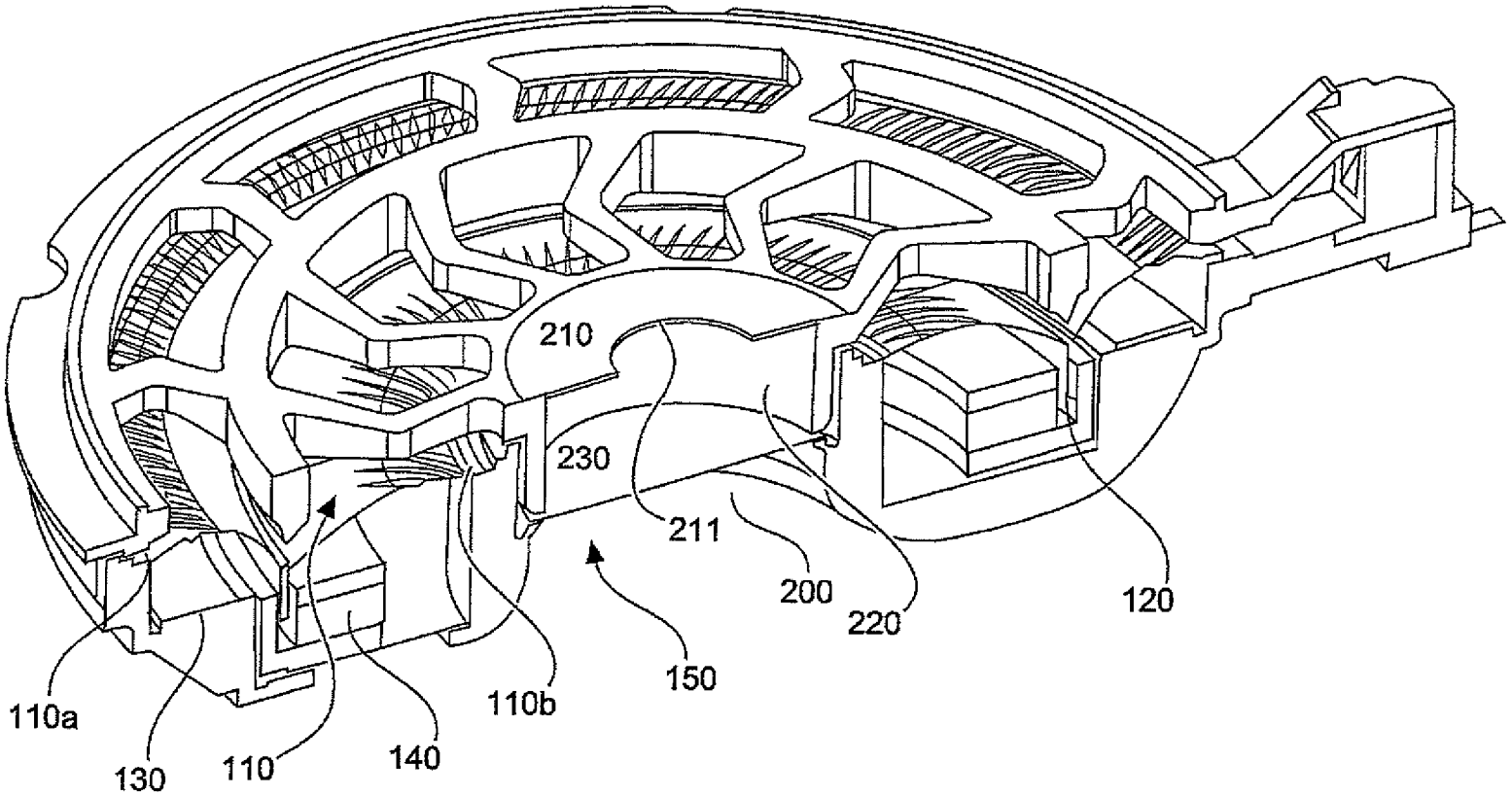
FIG. 3 shows a perspective sectional view of an electrodynamic sound transducer according to a second exemplary embodiment.

FIG. 3 shows a perspective sectional view of an electrodynamic sound transducer according to a second exemplary embodiment. The dynamic sound transducer comprises a chassis 130, a membrane 110 with two grooves 110*a*, 110*b*, a moving coil 120, a magnetic system 140 and a hole 150 in the membrane on which a dome section is usually provided.

The membrane 110 according to the second exemplary embodiment is therefore configured as a membrane without a dome section. A resonator 200 is provided in the area of the hole 150 (and inside the inner end 132). The resonator 200 has a first end 210 with an opening 211, a second end 230 and a volume 220. The first end 210 is provided on the ear-side end of the electrodynamic sound transducer and has an opening 211. The second end 230 is configured to be closed. The opening 211 can be configured to be smaller than the hole 150.

The resonator 200 according to the invention can be configured as an acoustic absorption circuit or as a Helmholtz resonator. The opening 210 of the resonator 200 is located according to the invention in the transducer axis and is arranged on the side of the transducer facing the ear.

According to the invention, the first end 210 with the opening 211 is provided in the membrane plane. A volume 220 is formed between the first and second end 210, 230 which is only opened by the opening 211.

At the resonance frequency of the resonator, a sound velocity maximum is formed at the opening 211 through which energy is extracted from the acoustic field produced by the electrodynamic sound transducer.

Figure 4:
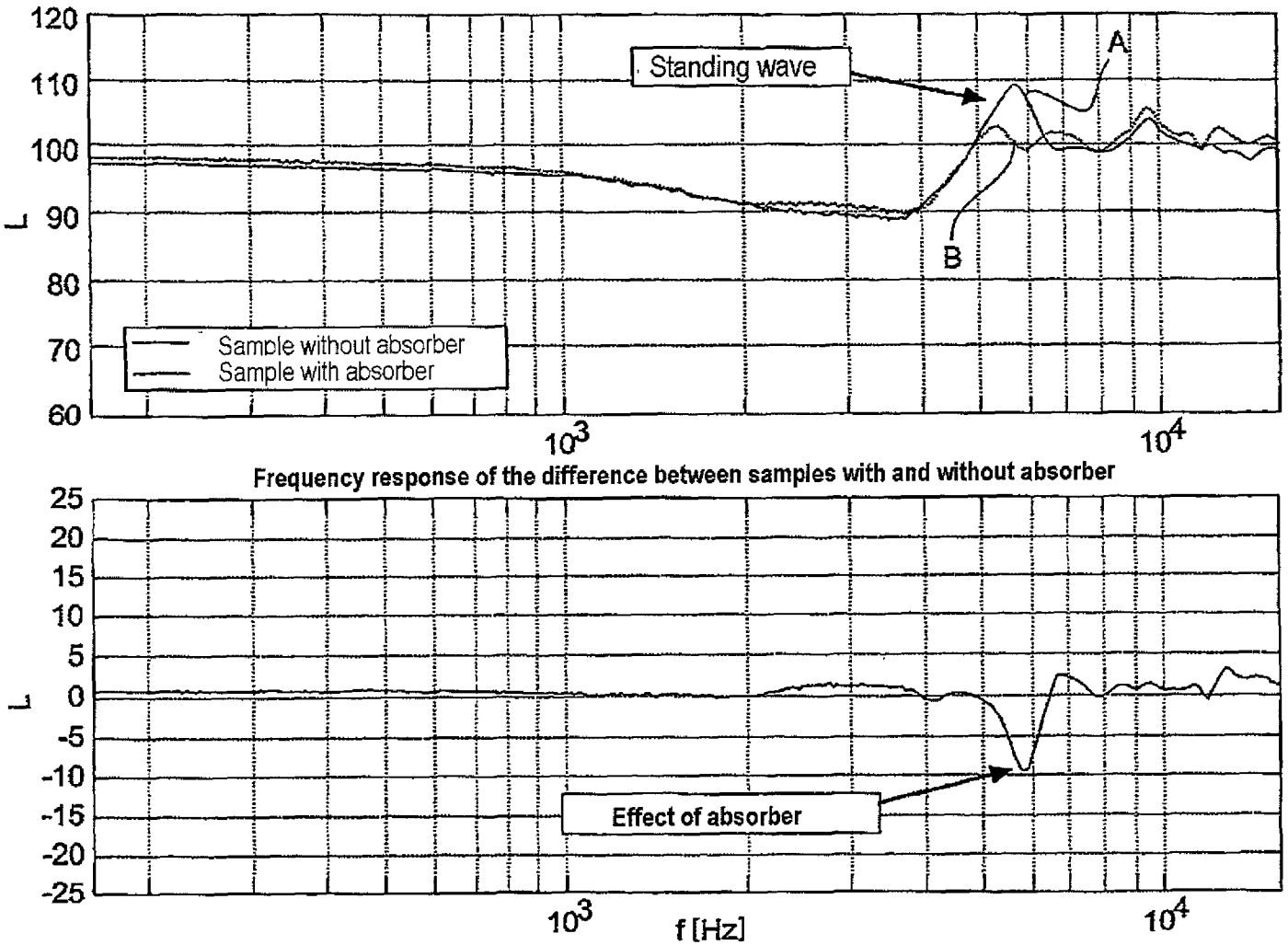
FIG. 4 shows a frequency response of an electrodynamic sound transducer with and without the resonator according to the invention.

FIG. 4 shows a first frequency response A of a transducer without the resonator and a second frequency response B for an electrodynamic sound transducer with a resonator according to the invention. Furthermore, FIG. 4 shows a frequency response of the difference between the first and second frequency response A, B. Thus, in particular the effect of the resonator can be clearly seen in the lower diagram.

Optionally an acoustic resistance can be provided in or on the opening 211 of the resonator 200 for combatting.

According to one aspect of the invention, the chassis has an inner circular end and an outer circular end on which the membrane is fastened.

An (acoustic) resonator according to the invention influences the sound at a certain frequency or a certain frequency range. The resonator can have a capacitive acoustic element and an inductive acoustic element.

According to one aspect of the invention, the resonator can be configured as a cavity resonator with a volume having a single opening towards the ear canal.

Optionally an oscillatory membrane can be provided in or on the opening 211 of the resonator.

According to one aspect of the invention, the sound transducer comprises a ring radiator. The ring radiator has a chassis 130 with an inner open circular end 132 and an outer circular end 131 and an oscillatory membrane 110 with a hole 150 in the centre, an inner and an outer bead 110*b*, 110*a* and a coil seat 122. The membrane 110 is held or fastened on the inner and outer end 132, 131 of the chassis. A resonator 200 is provided inside the inner open circular end 132 of the chassis 130 and inside the hole 150.

The resonator can operate as an absorber.

The resonator according to the invention is an oscillatory system whose components are tuned to a specific frequency (eigenfrequency) or frequency range so that the resonator decays when excited at this frequency or this frequency range. The acoustic resonator according to the invention has a closed or partially open air volume. The elasticity of the air in a cavity together with the mass inertia of the air results in specific resonance frequencies. The Helmholtz resonator is a partially open cavity resonator.

The invention also relates to a microphone or an earphone having the sound transducer described above.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope

The invention claimed is:

1. An earphone comprising:

an electrodynamic sound transducer comprising:

a chassis with an inner open end and an outer end;

a membrane with a hole in a center of the membrane and a coil seat, wherein the membrane is fastened to the inner open end and the outer end;

a moving coil, which is coupled to the membrane at the coil seat;

a magnetic system; and a resonator, which is formed in the inner open end of the chassis and in the hole in the center of the membrane;

wherein the resonator has:

a first end with an opening on an ear-side end of the electrodynamic sound transducer;

a second end on a side of the electrodynamic sound transducer facing away from the ear; and a volume between the first end and the second end;

wherein the second end is closed;

wherein the resonator is configured as an acoustic absorption circuit or as a Helmholtz resonator.

2. The electrodynamic sound transducer according to claim 1;

wherein the opening is smaller than the hole in the center of the membrane.

3. The electrodynamic sound transducer according to claim 1;

wherein the first end with the opening is located in a plane of the membrane.

4. The electrodynamic sound transducer according to claim 1;

wherein an acoustic resistance element is provided at the opening.

* * * * *